US005439372A

United States Patent [19]

Duret et al.

[11] Patent Number: 5,439,372

[45] Date of Patent: Aug. 8, 1995

[54] MULTIPLE FIRING RATE ZONE BURNER AND METHOD

[75] Inventors: Michael J. Duret, Pleasanton; Robert M. Kendall, Sunnyvale; Frederick E. Moreno, Los Altos, all of Calif.

[73] Assignee: Alzeta Corporation, Santa Clara, Calif.

[21] Appl. No.: 83,353

[22] Filed: Jun. 28, 1993

[51] Int. Cl.[6] ..... F23D 14/14

[52] U.S. Cl. ..... 431/7; 431/326; 431/328; 431/2

[58] Field of Search ..... 431/326, 171, 328, 329, 431/2, 7, 12; 126/373

[56] References Cited

U.S. PATENT DOCUMENTS

| | | | |
|---|---|---|---|
| 4,597,734 | 7/1986 | McCausland et al. | 431/328 |
| 4,676,222 | 6/1987 | Jones et al. | 126/91 A |
| 4,976,609 | 12/1990 | Grob et al. | 126/373 X |
| 5,174,744 | 12/1992 | Singh | 431/326 X |
| 5,215,457 | 6/1993 | Sebastiani | 431/326 X |
| 5,306,140 | 4/1994 | Smith | 431/328 |

FOREIGN PATENT DOCUMENTS

| | | | |
|---|---|---|---|
| 0157432 | 12/1988 | European Pat. Off. | F23D 14/16 |
| WO93/18342 | 9/1993 | WIPO . | |

OTHER PUBLICATIONS

Flyer: Burner Systems International/Furigas undated. "Low-$No_x$ Metal-Fiber Gas Burner" One page.

Global Environmental Solutions Brochure Titled "Ceramic Fiber Gas Burner", 7 pages, undated.

Flyer: "Metal Fiber Burner Material Provides Multiple Solutions" Natural Gas Applications In Industry, Winter 1992.

Acotech, Aug. 13, 1992. Test of a Cylindrical Perforated MFB Burner in a Condensing Boiler of 180 kW.

Brochure: Acotech, Jul. 1991 "Metal Fibre Burner Surface Combustion".

Flyer: "Furigas Metal Fibre Burner".

*Primary Examiner*—Larry Jones

*Attorney, Agent, or Firm*—W. Patrick Bengtsson; Limbach & Limbach

[57] ABSTRACT

A gaseous fuel burner and method in which a high-firing rate (blue/non-surface radiant) zone is created between two lower firing rate (red/surface radiant) combustion zones. The method of the invention can be achieved by selective perforation of porous sintered fiber mat burner surfaces to achieve improved burner performance and relatively low $NO_x$ emissions.

17 Claims, 4 Drawing Sheets

MULTIPLE FIRING RATE ZONE BURNER AND METHOD

BACKGROUND OF THE INVENTION

1. Field of the Invention

This invention relates to a combustion method (e.g. for natural gas) and a burner which can be used for the method. In particular the invention is directed to a method in which combustion zones operating in the surface radiant mode are created on the surface of a burner, while at the same time blue flame combustion zones are operated in areas surrounded by the surface radiant zones.

2. Discussion of the Prior Art

Surface combustion radiant burners have been known for some time. Exemplary is U.S. Pat. No. 4,597,734 to McCausland et al., which describes a surface combustion radiant: burner including a porous burner surface made of metal fibers. Porous metal fiber "mats" are advantageous for reasons including their high temperature stability, corrosion resistance, low thermal conductivity, high emissivity and ability to be formed in varying shapes for particular burner applications.

Surface combustion radiant burner designs have been studied to identify designs with greater thermal efficiency and low $NO_x$ emissions. One metal fiber system uses a perforated metal fiber mat, which design has been incorporated in metal fiber burners sold by N. V. Acotech S. A. of Zwevegem, Belgium. Such burners can be run over a broad firing range from the surface radiant mode to the blue flame mode. Studies indicate, however, that no satisfactory solution has been identified for achieving relatively high overall firing rates (e.g. surface firing rates near 1,000,000 btu/hr-ft$^2$) while at the same time maintaining low $NO_x$ emissions at excess air levels less than 15%. Low excess air operation is necessary to maintain high thermal efficiencies. Further, such studies have identified additional problems such as burner "screechings" when operating at low excess air conditions.

SUMMARY OF THE INVENTION

The present invention is a further improvement in operation in which surface radiant and blue flame zones are simultaneously created on a burner surface. The invention results in very low $NO_x$ emissions, even at high overall firing rates and moderate excess air levels.

Thus, in a first embodiment, the invention is a gaseous fuel burning method comprising the steps of introducing a premixed fuel-oxidizer mixture to a burner surface; creating a first surface radiant combustion zone on the burner surface at a first firing rate; creating a second surface radiant combustion zone on the burner surface at a second firing rate; and creating, at a third firing rate higher than the first and second firing rates, a non-surface radiant combustion zone between the first and second surface radiant combustion zones.

In another embodiment of the invention the method includes the step of flowing the fuel-oxidizer mixture to the burner surface through a porous metal fiber mat.

At the burner surface, the first and second zone firing rates can range from 35,000 btu/hr-ft$^2$ to 200,000 btu/hr-ft$^2$, are preferrably from 50,000 btu/hr-ft$^2$ to 150,000 btu/hr-ft$^2$, and are most preferrably in the range 100,000 btu/hr-ft$^2$ to 150,000 btu/hr-ft$^2$.

The firing rate for the third zone ranges from 500,000 to 8,000,000 btu/hr-ft$^2$.

In another embodiment, multiple surface radiant and non-surface radiant zones form a striped pattern on the burner surface. In this method, a ratio of the area defined by the surface radiant zones to the area defined by the non-surface radiant zones can be from 1:1 to 2.5:1, and each of the non-surface radiant zones can have a stripe width of from one-half to one inch. Most preferrably, the ratio of the areas of the surface radiant to the non-surface radiant zones is 1.6:1 in this particular embodiment.

In yet another embodiment, the invention is a gaseous fuel burning method comprising the steps of introducing a premixed fuel-oxidizer mixture to a combustion plate arrangement, the combustion plate arrangement including a porous burner plate having a burner surface; creating at least two surface radiant combustion zones at a first firing rate; and creating a non-surface radiant combustion zone at a second firing rate higher than the first firing rate, the non-surface radiant combustion zone being disposed between the surface radiant zones.

In another embodiment the invention is a gaseous fuel burning method comprising the steps of introducing a premixed fuel-oxidizer mixture to a burner surface of a combustion plate arrangement; creating at least two surface radiant combustion zones on the burner surface at a first firing rate; and creating a non-surface radiant combustion zone on the burner surface at a second firing rate higher than the first firing rate, the non-surface radiant combustion zone being disposed between the surface radiant zones.

The invention also includes a burner comprising means for introducing a premixed fuel-oxidizer mixture to the surface of a burner; means for creating a first surface radiant combustion zone on the burner surface at a first firing rate; means for creating a second surface radiant combustion zone on the burner surface at a second firing rate; and means for creating, at a third firing rate higher than the first and second firing rates on the burner surface, a non-surface radiant combustion zone positioned between the first and second surface radiant combustion zones.

In this embodiment, the means for creating each of the first, second and third zones comprises a gas porous metal fiber matrix mat having greater porosity in an area defining the third zone than in areas defining the first and second zones. Alternatively, the areas defining the first and second zones have substantially the same porosity, and the means by which the difference in the combustion rate for the combustion zones is found elsewhere in the burner assembly.

In the preferred burner of the invention, the areas defining the first, second and third zones define a striped pattern on the burner surface, with the third zone being between the first and second zones.

BRIEF DESCRIPTION OF THE DRAWINGS

The invention will be better understood by reference to the appended figures of which.

DETAILED DESCRIPTION OF THE INVENTION

The present invention can use a porous sintered fiber mat of the type currently available, for example from N. V. Acotech S. A. of Zwevegem, Belgium, the mat being modified to create zones operating in the surface radiant and blue flame modes simultaneously on the burner surface.

Figure 1:
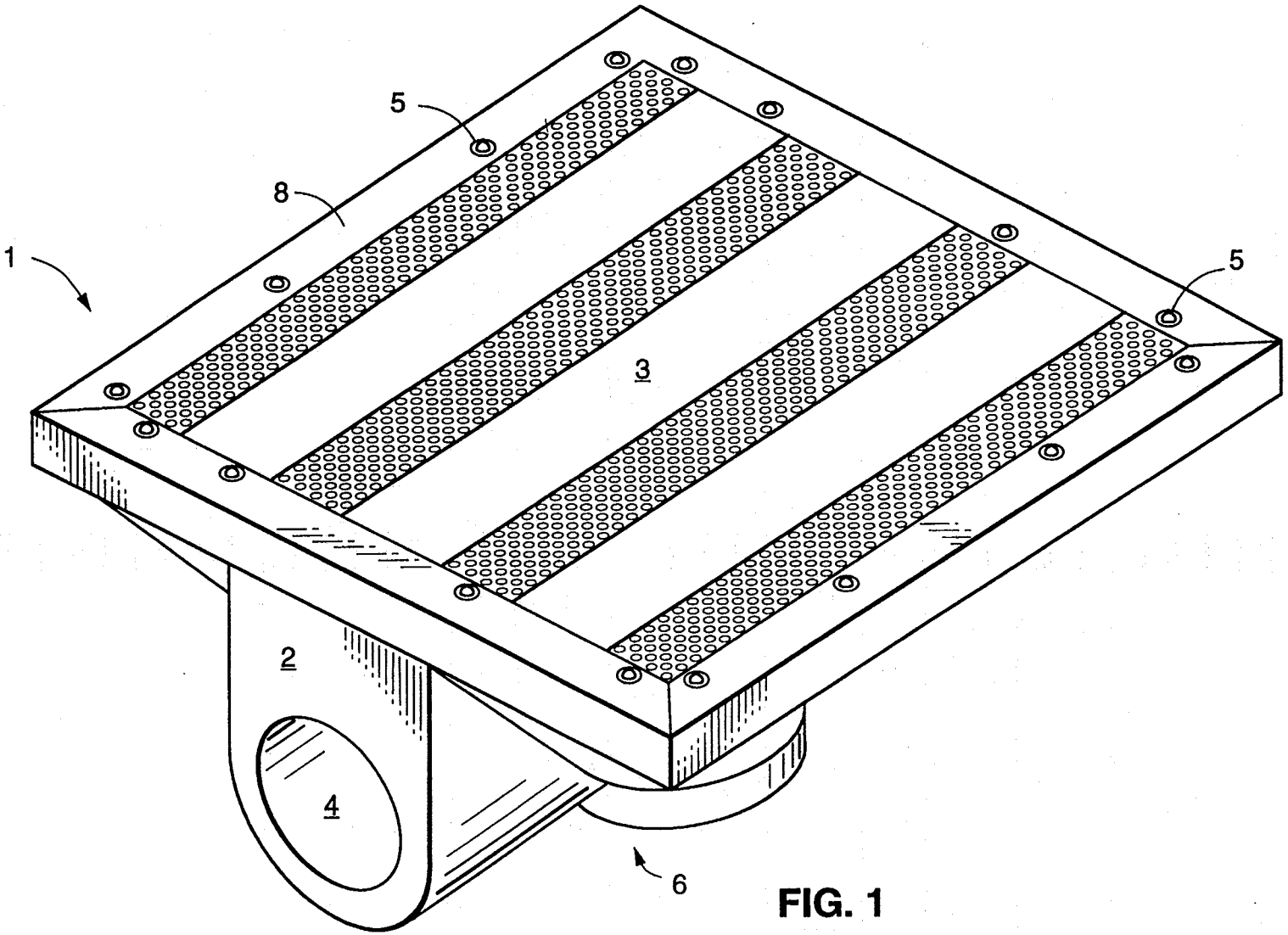
FIG. 1 is a perspective view of a burner assembly including the preferred burner mat design of the invention.
Figure 2:
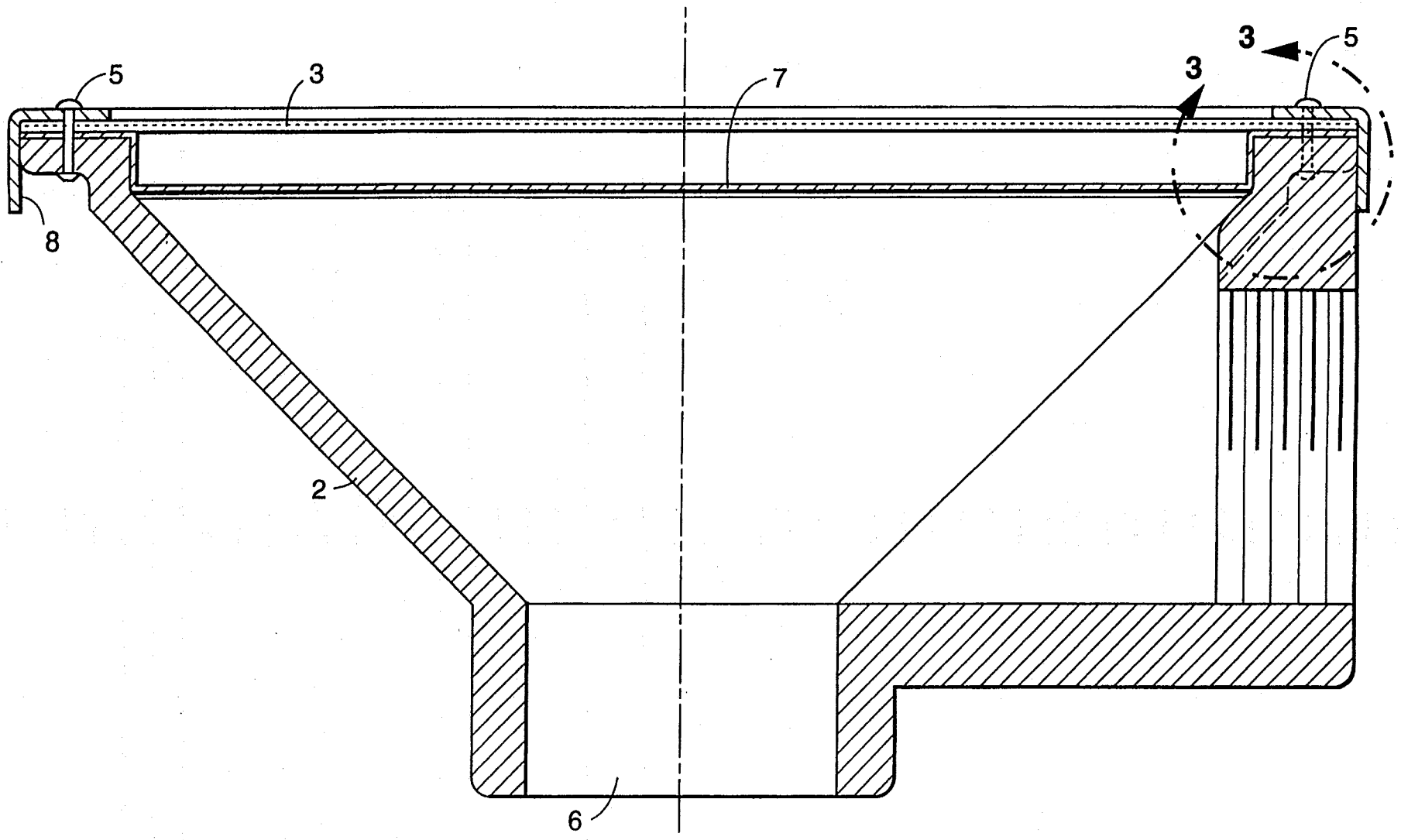
FIG. 2 is a cross-sectional view of the burner of FIG. 1, showing a preferred arrangement plenum/burner arrangement of the present invention.
Figure 4:
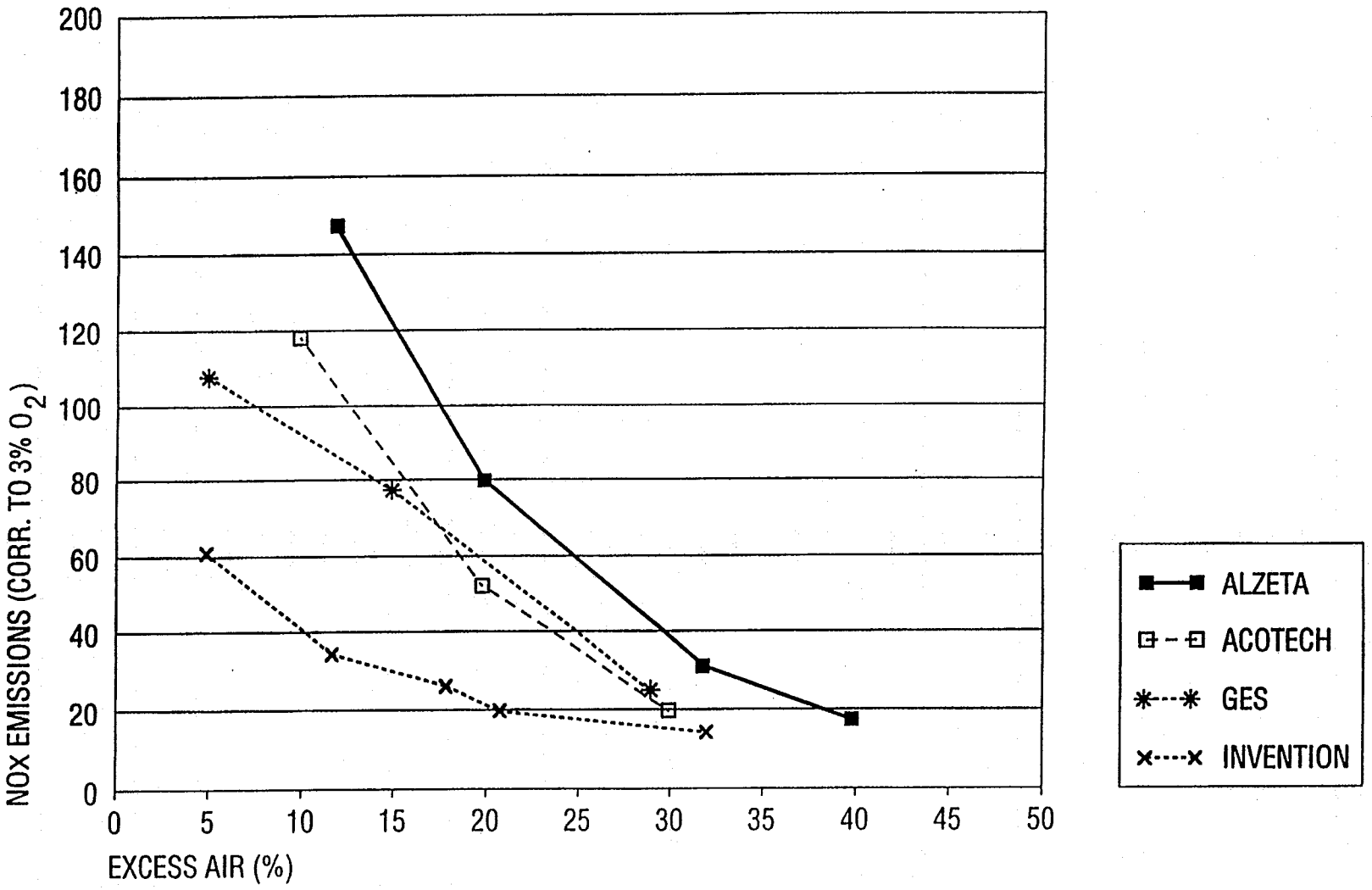
FIG. 4 is a graph showing baseline $NO_x$ emission performance for prior art burner designs compared with the present invention.

FIGS. 1 and 2 show the preferred burner in which such zones are obtained, though it is to be understood that many variations of the structure of such a burner are possible which would still take advantage of the alternating surface radiant/blue flame combustion zone method by which the substantially lower $NO_x$ results of the invention are achieved. FIG. 4 shows the reduced $NO_x$ emissions which result from the invention when compared with use of burners of the prior art.

As used herein, the phrase "surface radiation" refers to radiation which results from elevated burner material surface temperatures rather than from the gas-phase. Radiant burner materials have much higher emittances over a broad range of wavelengths than the hot combustion products of a conventional diffusion flame burner, and thus achieve higher radiant outputs at lower temperatures. The phrase "non-surface radiant" refers to portions of burner surface where higher firing rates result in blue flame operation and where virtually no burner surface radiation is created.

Figure 3:
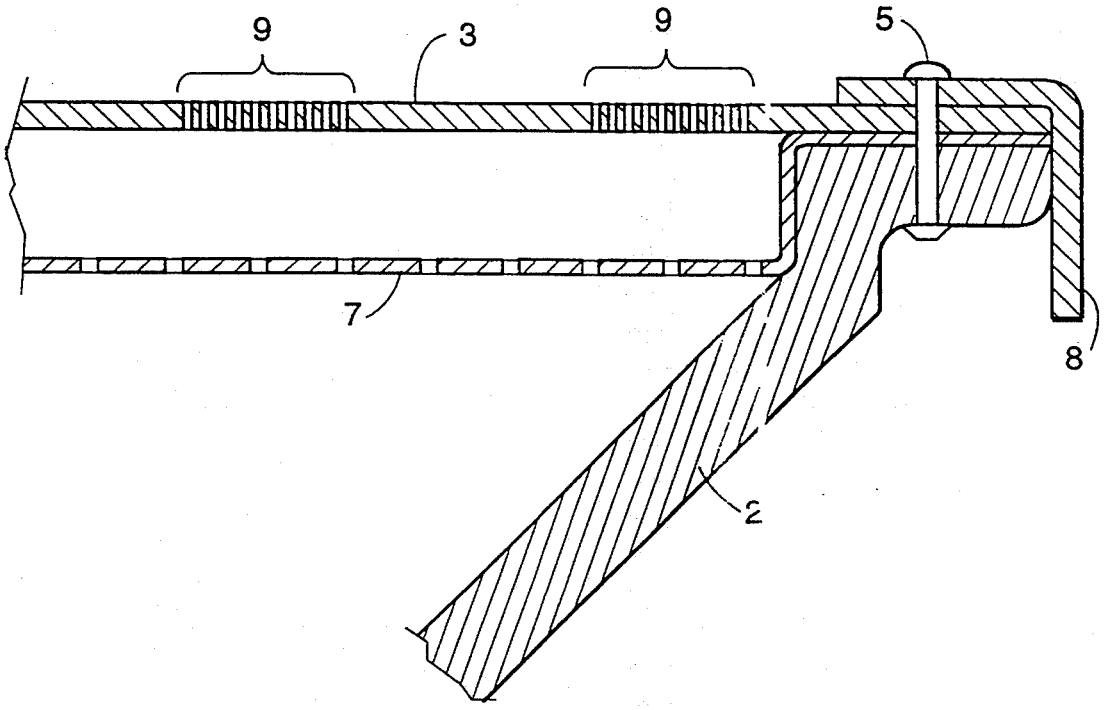
FIG. 3 is a detail view of a portion of the burner of the invention showing the perforations in the burner surface.

In FIGS. 1, 2 and 3, like numbers are used to indicate like elements.

FIG. 1 is a perspective view of burner assembly 1. Assembly 1 includes a cast iron plenum 2, and a sintered metal mat 3 on which combustion occurs. The components of assembly 1 are joined by fasteners 5.

Sintered metal mat 3 forms the burner surface on which combustion takes place.

In the method of the invention, a pre-mixed flow of fuel and air is introduced into a side or bottom port (4 and 6 respectively) of cast iron plenum 1 and flows through backing plate 7 (FIG. 2). Backing plate 7 is perforated sheet metal consisting of 0.066 inch diameter holes on 0.25 inch centers to provide approximately 5% open area, and serves to evenly distribute the premixed flow of fuel and air to sintered metal mat 3 located downstream of the backing plate. Backing plate 7 also serves as a flame arrester to prevent the fuel-air mixture from burning backwards and igniting the fuel-air mixture in the plenum. The burner surface is preferably a porous, sintered metal fiber mat 3 made from oxidation-resistant alloy fibers, such as an iron chromium aluminum alloy material, sold by Acotech. Burner mat 3 is preferably maintained between 1/16 and ½ inch above the backing plate. The burner mat is perforated with 0.030-inch diameter holes on 0.066-inch staggered centers providing 18% open area. The mat is selectively perforated in stripes such that each ½ inch wide perforated stripe is surrounded by 2¾-inch wide non-perforated stripes to maintain a ratio of surface radiant to blue flame zones at 1.5:1. Burner mat 3 and backing plate 7 are secured to plenum 2 using a frame 8 and fasteners 5, such as rivets or other similar fasteners to form a gas-tight seal between mat 3 and plenum 2.

Except for the selective perforation in the burner mat 3, the burner structure is known in the art, and is available from the assignee of the present invention, Alzeta Corporation of Santa Clara, Calif.

In FIG. 3 perforated portions 9 of sintered metal mat 3 can be better seen. The portions of mat 3 between perforated portions 9 are the part of the metal fiber mat through which holes have not been drilled. That is, portions 9 are porous metal fibers which have been perforated. The remainder of the mat is porous but not perforated.

EXAMPLES

The apparatus used to obtain the prior art test results in FIG. 4 was a burner assembly as described in FIGS. 1, 2 and 3 using a fully perforated Acotech sintered metal mat as the burner surface. Data was collected for assignee's prior art system (labelled "Alzeta") and published data for two other systems was also studied (labelled "Acotech" and "GES"), see FIG. 4. The Acotech burner is a porous metal fiber mat which is fully perforated. The GES burner is a non-perforated, porous ceramic foam operating in the blue-flame mode.

The Alzeta data was collected in a Teledyne Laars "Mighty Therm" boiler. A combustion air blower of sufficient capacity to fire 500,000 btu/hr at 50% excess air was used. Natural gas was added to the airstream sufficiently upstream of the burner plenum to supply a well-mixed fuel-air stream to the plenum. The flow of natural gas was measured with a dry gas meter similar to residential gas meters. The air flow was determined based on measurements using a Thermox Model CMFA-P portable pre-mix analyzer. This analyzer samples a small amount of the incoming pre-mixed fuel and air, combusts the sample, and measures the residual oxygen.

The burner element was fit into a 500,000 btu/hr Teledyne Laars "Mighty Therm" hot water boiler and fired at the boiler's full capacity resulting in a nominal burner surface firing rate of 1,000,000 btu/hr-ft $^2$ at various .excess air levels as determined by the pre-mix analyzer.

Emissions samples were collected with a stainless steel probe in the flue stack downstream of the hot water tubes. After condensing out the water vapor in the emissions sample, a Thermoenvironmental model 10S chemiluminecsent analyzer determined the resulting $NO_x$ emissions.

Data for the present invention was collected by replacing the fully perforated porous metal fiber mat used for the Alzeta test with a mat which had been perforated in ½ inch wide strips separated on both sides with ¾ inch wide non-perforated strips of the type shown in FIGS. 1-3. In this form of the selectively perforated burner mat, the differences in pressure drop through the holes versus the unperforated zones of the porous sintered metal fiber mat create regions of different surface firing rates. The perforated regions fire in the blue flame mode and the unperforated regions operate radiantly at much lower surface firing rates. In order to maintain the surface radiant operation in the unperforated zones, it is preferred that surface firing rates between 50,000 btu/hr-ft$^2$ and 150,000 btu/hr-ft$^2$ be maintained. Since the overall surface firing rate through the selectively perforated mat remains unchanged from the surface firing rate through the uniformly perforated mat, the blue flame zones operate at surface firing rates much greater than 1,000,000 btu/hr-ft$^2$.

The burner including the selectively perforated mat was replaced into the boiler and fired at the same firing rate and various excess air levels as the prior art burners. Emissions data were collected in the same fashion as above.

As seen in FIG. 4, the data show a significant lowering of $NO_x$ emissions using the present invention. For example, at 20% excess air, $NO_x$ emissions are reduced from 80 ppm for the fully perforated Alzeta mat to less than 30 ppm, corrected to 3% oxygen. Likewise, with respect to the reported GES and Acotech data, significantly lower $NO_x$ results are obtained.

We also tested the $NO_x$ emission performance of the invention by varying the ratio of area of the zones of the surface radiant and blue flame regions relative to one another. The results are shown in Table I. This table shows that where the preferred "striped" mode of the invention is used an optimum ratio of the surface radiant burner area to blue flame (or non-surface radiant) area was about 1.6. Importantly, however, it should be noted that all of these runs resulted in significantly improved (lower) $NO_x$ than the run where R/B=0.

TABLE I

| R/B = 0 | | R/B = 1 | | R/B = 1.6 | | R/B = 2 | | R/B = 2.5 | |
|---|---|---|---|---|---|---|---|---|---|
| % EXCESS AIR | $NO_x$ | % EXCESS AIR | $NO_x$ | % EXCESS AIR | $NO_x$ | % EXCESS AIR | $NO_x$ | % EXCESS AIR | $NO_x$ |
| 12 | 147 | 11 | 66 | 5 | 61 | 5 | 73 | 5 | 71 |
| 20 | 65 | 17 | 42 | 12 | 34 | 11 | 44 | 11 | 53 |
| 32 | 30 | 18 | 40 | 18 | 26 | 17 | 34 | 14 | 49 |
| 40 | 17 | 27 | 17 | 21 | 19 | 21 | 28 | 18 | 42 |
| | | | | 32 | 14 | 26 | 22 | 26 | 33 |
| | | | | | | 32 | 19 | | |
| | | | | | | 40 | 12 | | |

SURFACE FIRING RATE = 900 TO 1000 MBTU/HR-FT$^2$
ALL $NO_x$ READINGS IN ppm AND CORRECTED TO 3% OXYGEN
"B" DIMENSION FIXED AT ½ INCH
"R/B" IS THE RATIO OF SURFACE RADIANT AREA TO BLUE FLAME AREA While the mechanism by which the significantly reduced $NO_x$ emissions are achieved is not well understood, the firing of the burner with adjacent surface radiant and blue flame zones appears to be a key feature. Those skilled in the art will understand that there are many ways to obtain such adjacent zones other than the preferred selectively perforated mat method described herein. For example, selective perforation of the backing plate and/or sintered mat with geometries other than stripes as discussed above could be used. These could take the form of checkerboard or circle shapes. Where uniform perforations are used in the sintered metal mat, selective perforations could be used on the backing plate. Additionally, flow baffles that create zones of different firing rates on the perforated metal mat could be used. Different firing rate zones could also be achieved by fully perforating the mat with variable hole sizes and spacings. Fuel/air nozzles could be used to create high surface firing rate zones interspaced between surface radiant zones. Another approach would be to place porous barriers such as foams or other sintered mats in the space between the backing plate and metal mat burner to create zones of different surface firing rates.

The geometry of the mat used in the burner is not limited to flat plates, but (as is common with metal fiber burners) other shapes such as cylindrical, square, diamond or other cross-sectional shapes can be used.

What is claimed is,:

1. A gaseous fuel burning method comprising the steps of:

(a) introducing a premixed fuel-oxidizer mixture to a burner surface;

(b) creating a first radiant combustion zone on said burner surface at a first firing rate;

(c) creating a second radiant combustion zone on said burner surface at a second firing rate; and (d) creating, at a third firing rate higher than said first and second firing rates, a non-surface radiant combustion zone between said first and second radiant combustion zones on said burner surface.

2. A fuel burning method as in claim 1 wherein the steps of creating said first and second radiant combustion zones each comprise the step of flowing said fuel-oxidizer mixture to said surface in said zones at a firing rate of from 35,000 to 200,000 btu/hr per ft$^2$ of each of said first and second zones.

3. A fuel burning method as in claim 2 wherein said burner surface is formed on a metal fiber mat wherein said steps of creating each of said first, second and third zones includes the step of flowing said fuel-oxidizer mixture to said surface through said mat.

4. A fuel burning method as in claim 2 wherein said first and second zone firing rates are from 50,000 to 150,000 btu/hr per ft$^2$ of each of said zones.

5. A fuel burning method as in claim 4 wherein said third zone firing rate is from 500,000 to 5,000,000 btu/hr per ft$^2$ of said third zone.

6. A fuel burning method as in claim 1 further comprising the step of creating additional radiant combustion zones on said burner surface, and creating additional non-surface radiant combustion zones on said burner surface at a firing rate greater than a firing used to create any one of said radiant combustion zones, wherein no two of said non-surface radiant combustion zones are adjacent to one another.

7. A fuel burning method as in claim 6 wherein said radiant and non-surface radiant zones form a striped pattern on said surface.

8. A fuel burning method as in claim 7 wherein each of said zones defines an area on said surface, and a ratio of the area defined by said radiant zones to the area defined by said non-surface radiant zones ranges between 1 to 1 and 2.5 to 1.

9. A fuel burning method as in claim 7 wherein each of said non-surface radiant zones has a stripe width of from one-half to one inch.

10. A fuel burning method as in claim 8 wherein said ratio of the area defined by said radiant zones to the area defined by said non-surface radiant zones is about 1.6 to 1.

11. A gaseous fuel burning method comprising the steps of:

(a) introducing a premixed fuel-oxidizer mixture to a combustion plate arrangement, said combustion plate arrangement including a porous burner plate having a burner surface;

(b) creating at least two radiant combustion zones at a first firing rate; and (c) creating a non-surface radiant combustion zone at a second firing rate higher than said first firing rate, said non-surface radiant combustion zone being disposed between said radiant zones.

12. A gaseous fuel burning method comprising the steps of:

(a) introducing a premixed fuel-oxidizer mixture to a burner surface of a combustion plate arrangement;

(b) creating at least two radiant combustion zones on said burner surface at a first firing rate; and (c) creating a non-surface radiant combustion zone on said burner surface at a second firing rate higher than said first firing rate, (d) said non-surface radiant combustion zone being disposed between said radiant zones.

13. A gaseous fuel burner comprising:

(a) means for introducing a premixed fuel-oxidizer mixture to the surface of a burner;

(b) means for creating a first radiant combustion zone on said burner surface at a first firing rate;

(c) means for creating a second radiant combustion zone on said burner surface at a second firing rate; and (d) means for creating, at a third firing rate higher than said first and second firing rates on said burner surface, a non-surface radiant combustion zone positioned between said first and second radiant combustion zones.

14. A gaseous fuel burner as in claim 13 wherein said means for creating each of said first, second and third zones comprises a gas porous metal fiber matrix mat having greater porosity in an area defining said third zone than in areas defining said first and second zones.

15. A gaseous fuel burner as in claim 14 wherein said areas defining said first and second zones have substantially the same porosity.

16. A gaseous fuel burner as in claim 14 wherein said areas defining said first, second and third zones define a striped pattern on said burner surface.

17. A gaseous fuel burning method comprising the steps of:

(a) introducing .a premixed fuel-oxidizer mixture to a burner surface; and (b) simultaneously creating first, second and third radiant combustion zones on said burner surface such that (1) said first and second combustion zones are created at a first firing rate of from 35,000 to 200,000 Btu/hr per $ft^2$; and (2) said third combustion zone is created at a second firing rate of from 500,000 to 8,000,000 Btu/hr per $ft^2$ as a non-surface radiant combustion zone.

* * * * *